US010046836B2

(12) United States Patent
Hall

(10) Patent No.: US 10,046,836 B2
(45) Date of Patent: Aug. 14, 2018

(54) RETRACTABLE FIN AND FIN BOX

(71) Applicant: Twitch, LLC, Steamboat Springs, CO (US)

(72) Inventor: Peter Hall, Steamboat Springs, CO (US)

(73) Assignee: Twitch, LLC, Steamboat Springs, CO (US)

( * ) Notice: Subject to any disclaimer, the term of this patent is extended or adjusted under 35 U.S.C. 154(b) by 0 days.

(21) Appl. No.: 15/278,778

(22) Filed: Sep. 28, 2016

(65) Prior Publication Data

US 2017/0096199 A1 Apr. 6, 2017

Related U.S. Application Data

(60) Provisional application No. 62/237,932, filed on Oct. 6, 2015.

(51) Int. Cl.

| | |
|---|---|
| ***B63B 1/00*** | (2006.01) |
| ***B63B 35/00*** | (2006.01) |
| ***B63B 35/79*** | (2006.01) |

(52) U.S. Cl.

CPC ..... *B63B 35/7926* (2013.01); *B63B 35/793* (2013.01)

(58) Field of Classification Search

CPC ..... B63B 35/7926; B63B 35/793
USPC ..... 441/65, 74, 79
See application file for complete search history.

(56) References Cited

U.S. PATENT DOCUMENTS

| | | | | |
|---|---|---|---|---|
| 3,087,173 | A * | 4/1963 | Meyer | B63B 35/81 114/132 |
| 3,516,100 | A | 6/1970 | Ellis | |
| 5,129,344 | A * | 7/1992 | Ono | B63B 35/7926 114/127 |
| 5,356,324 | A | 10/1994 | Cunningham | |
| 8,632,373 | B2 | 1/2014 | Chambers | |
| 8,657,639 | B2 | 2/2014 | McIlwain | |
| 9,067,653 | B2 | 6/2015 | Green | |

* cited by examiner

*Primary Examiner* — Daniel V Venne
(74) *Attorney, Agent, or Firm* — Trenner Law Firm, LLC; Mark D. Trenner

(57) ABSTRACT

A retractable fin system having a retractable fin and fin box is disclosed. An example retractable fin system includes a housing insertable into an opening in a watercraft board. The example retractable fin system also includes a retractable fin. The example retractable fin system also includes a bias to maintain the retractable fin in a default outward position from the housing. The bias retracts the retractable fin into the housing on contact with an outside force.

16 Claims, 8 Drawing Sheets

RETRACTABLE FIN AND FIN BOX

PRIORITY CLAIM

This application claims the priority filing date of U.S. Provisional Patent Application No. 62/237,932 filed Oct. 6, 2015 for "Retractable Fin and Fin Box" of Peter Hall, hereby incorporated by reference in its entirety as though fully set forth herein.

BACKGROUND

Fins for watercraft come in various formats. Fins are typically attached to the watercraft or form a part of the watercraft, usually in a position underneath the watercraft to have constant contact with the water. Fins help keep the watercraft moving in the desired direction. Most surfboards and Standup Paddle (SUP) boards have fins, and most fins break on impact with an external force (e.g., hitting a rock or other hard object during use in the water or during transport). The fin may break or snap off the board upon impact, and the attachment point of the fin to the board may also break.

Repairing a board after a break is costly, and the board is never "good as new" after a fin repair. Water tends to get into the inside portion of the board (that should stay dry), which can cause water damage that can be difficult or even impossible to reverse. A broken fin housing on an inflatable board may be repaired if done professionally, which can be costly.

Attempts to reduce damage to the fins include providing retractable fins, similar to U.S. Pat. No. 5,356,324. A parallel retracting fin is disclosed in U.S. Pat. No. 8,657,639. U.S. Pat. No. 3,516,100 discloses an adjustable fin depth based on speed of the watercraft. U.S. Pat. No. 8,632,373 discloses a side-folding fin. U.S. Pat. No. 9,067,653 discloses a fin for a plastic board, and, while it does describe a retractable fin, the fin and fin housing is specific to a specific vessel, and is made to be fixed in certain set positions. These are not solutions that can be used with various types of watercraft boards.

DETAILED DESCRIPTION

A retractable fin and fin box is disclosed. In an example, the retractable fin and fin box is self-contained, including a retractable fin box, fin, and spring set that can fit both hard and inflatable boards (e.g., surf boards and SUP boards), and other watercraft. During use, the fin retracts (e.g., when coming into contact with a surface or object that could otherwise damage or break the fin), and then instantly snaps back into place (e.g., as contact with the surface or object is removed).

In an example, the retractable fin system is fully functional as a standalone component (e.g., apart from the board). That is, the retractable fin system is not configured for use only with specific watercraft or via any special fitting or housing or other mechanism that is unique to any particular watercraft. Instead, the retractable fin and fin box disclosed herein is a universal solution that can be fit into a diverse range of different types and sizes of watercraft.

In use, the retractable fin and fin box also helps users to paddle rivers and shallow waterways without the worry the board's fin will strike the bottom, a rock, or other hazard (perhaps ejecting the user and/or breaking the fin). The retractable fin and fin box simply retracts into the board upon striking an object and springs back ready for action as soon as the fin is past the offending object.

The retractable fin and fin box also enables easier transport. Boards with the retractable fin and fin box can be readily stacked without concern that the fins will get in the way or break. That is, the fins do not need to be removed from the board for transport and/or storage (e.g., stacking).

Before continuing, it is noted that as used herein, the terms "includes" and "including" mean, but is not limited to, "includes" or "including" and "includes at least" or "including at least." The term "based on" means "based on" and "based at least in part on."

Figure 1A:
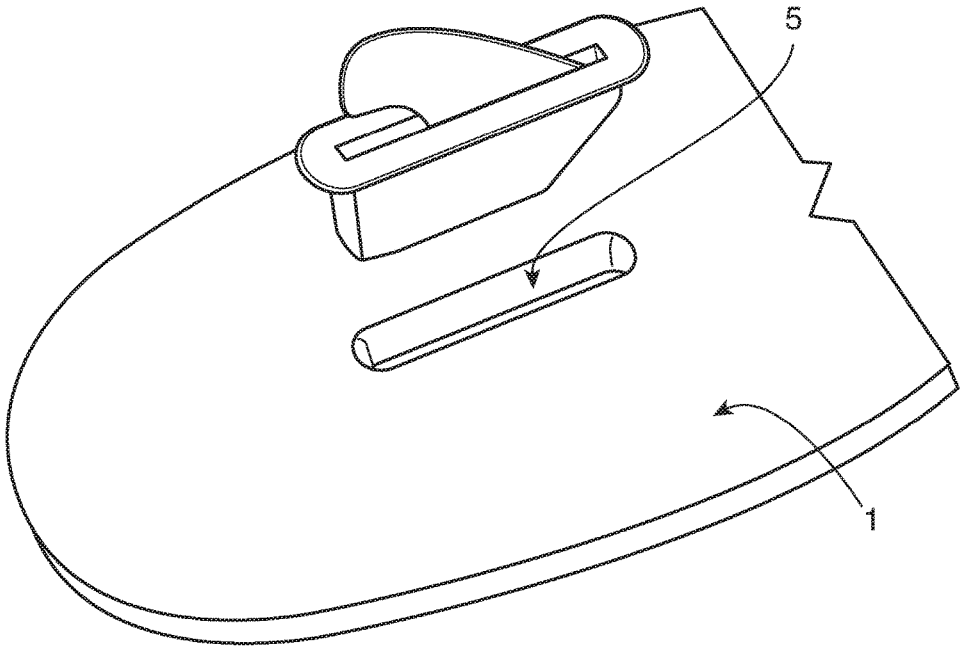
FIG. 1A shows an example retractable fin and fin box and a watercraft board.
Figure 1B:
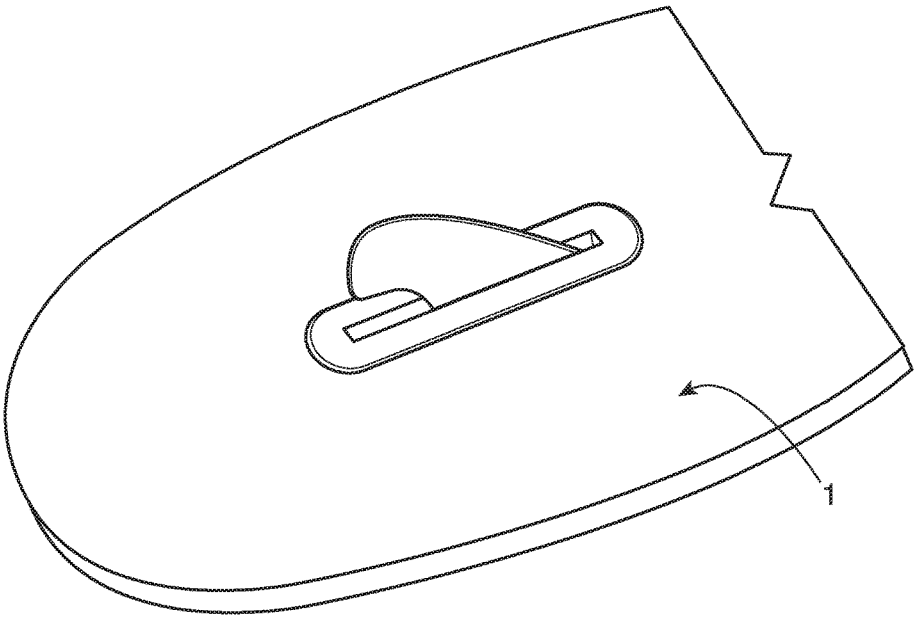
FIG. 1B shows an example retractable fin and fin box as it may be installed on a watercraft board.

FIG. 1A shows an example fin system 10 including retractable fin 14 and fin box 12, which may be implemented for a watercraft board. FIG. 1B shows the example fin system 10 as it may be installed on a watercraft board 1. It is noted that the retractable fin system is not limited to being implemented on any particular type of watercraft. For example, the example fin system 10 may be installed on a hard board or inflatable board (e.g., surfboard and SUP board).

In an example, the retractable fin system 10 includes a housing or fin box 12 that is insertable into an opening 5 in a watercraft board. A retractable fin is pivotably mounted within the fin box 12. A bias (e.g., spring 16 shown in FIG. 2A) maintains the retractable fin 14 in a default outward position from the fin box 12. The bias (e.g., spring 16) enables the retractable fin to at least partly, if not fully, retract into the fin box 12. For example, the retractable fin 14 may be in an extended or outward position by default, and then retract into the fin box 12 upon the fin 14 coming into contact with an outside force, such as but not limited to, hitting a rock, contacting a bottom surface of a lake or river, and/or stacking the board or watercraft on another board or surface.

In an example, the fin box 12 includes a rim 11. The rim 11 may be configured to be in substantially a same plane as a bottom surface of the watercraft board when the housing is fully inserted into the opening in the watercraft board. This enables the fin box 12 to be substantially flush with the bottom surface of the watercraft board. For example, the fin box 12 may be attached to the watercraft board by a process known in the industry as "glassing."

In an inflatable drop stitch product, there is an opening that is cut out of the bottom of the board. In an example, the opening is about 38 cm×6 cm, into which the fin box can be inserted. This opening is made airtight using the same sidewall construction techniques used to build the side rails of an inflatable drop stitch board. The housing 12 or "fin receiver assembly" enables an airtight bladder to surround it. The base plate of the fin box rests on the bottom of the board, directly outside of the cut out hole where the fin box is inserted. The fin receiver assembly is occupying space in what would normally be part of the inflatable chamber. The inflatable chamber is modified in a way that makes space for the box.

The retractable fin and fin box may replace a damaged fin, and/or used in new boards. The retractable fin and fin box may be implemented with any of a wide range of types and/or sizes of boards (e.g., surf boards and SUP boards).

The retractable fin and fin box may have a variety of fin sizes available for each box, including smaller and larger box systems for different types of fins, watercrafts, and applications. The retractable fin and fin box enables many different watercraft to accept the box and benefit from a spring-loaded retractable fin. It is a fully functional stand-alone unit that can solve problems by being added to the design many watercrafts. For example, the retractable fin and fin box can be added to inflatable surf/paddle boards, kayaks, boats, and other watercraft. The retractable fin and fin box is a universal retractable fin system.

An example retractable fin and fin box includes a spring-loaded retractable fin and a fin box that can be integrated in to a wide variety of watercrafts, including, but not limited to "hard" (plastic, epoxy, or other paddleboard construction) stand up paddle boards, kayaks, surf boards, and body/boogie boards. The example retractable fin and fin box can also be implemented with inflatable boards.

Figure 2A:
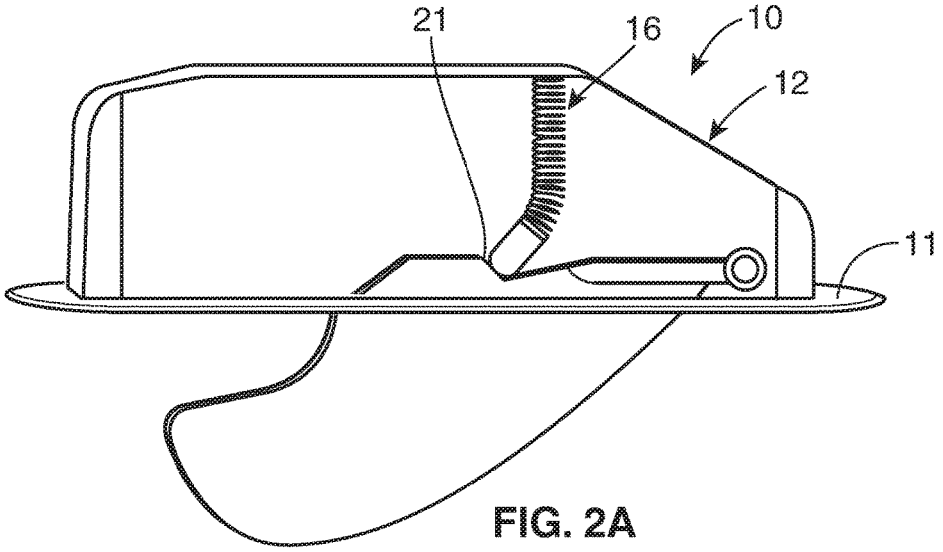
FIGS. 2A-2C show an example retractable fin and fin box, wherein A) is a side view, B) is a bottom view, and C) is a top view.
Figure 2B:
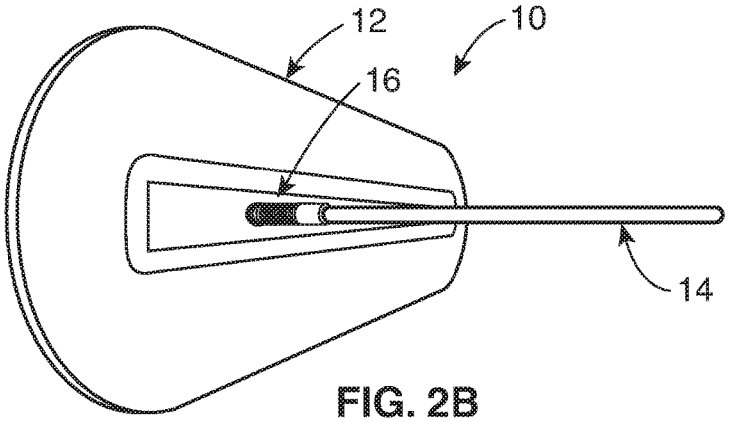
Figure 2C:
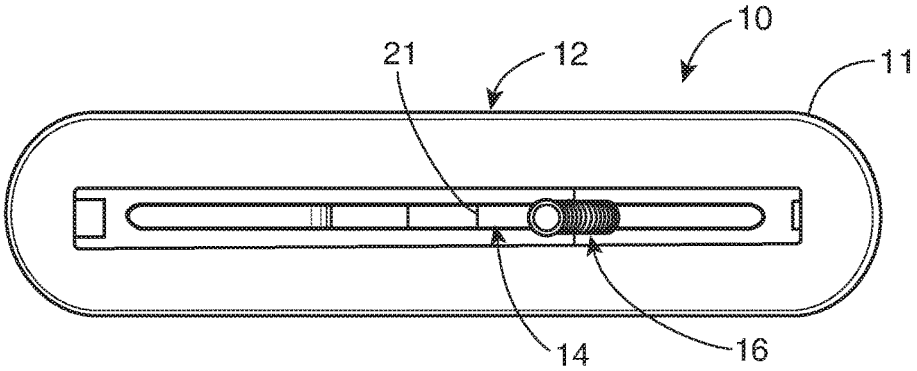
Figure 3A:
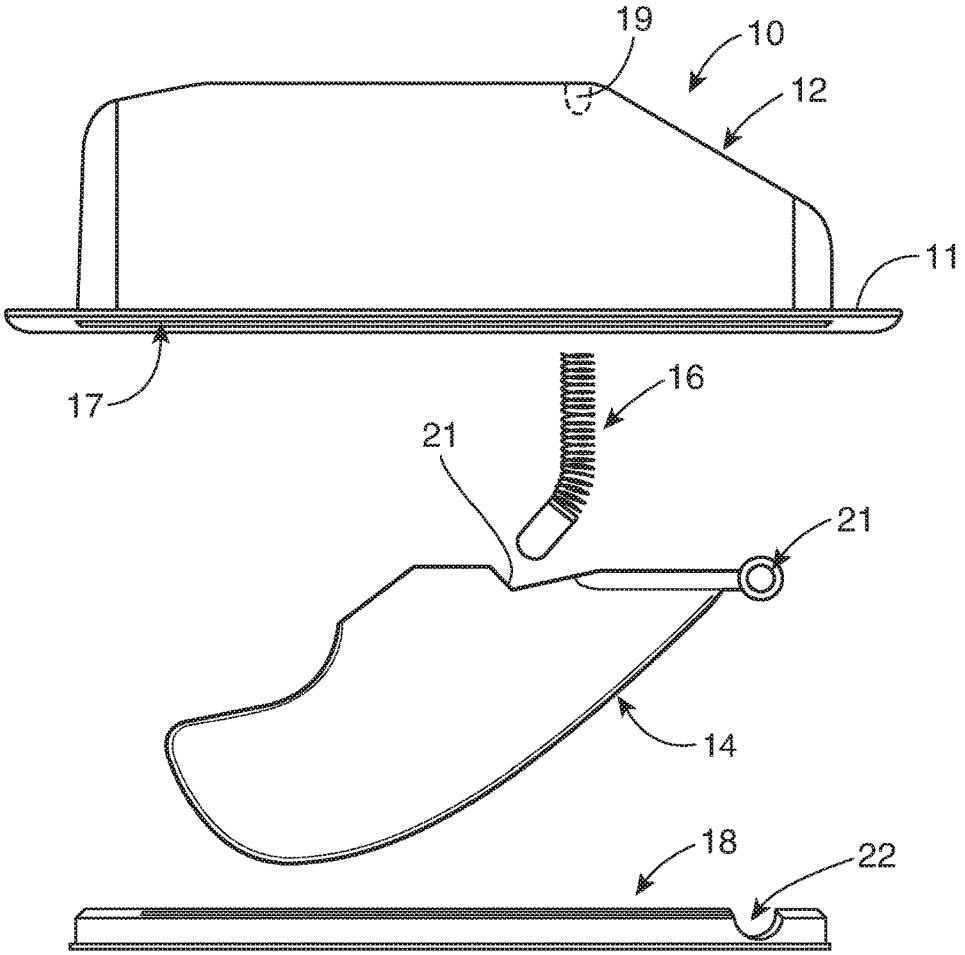
FIGS. 3A-3B show an example retractable fin and fin box, wherein A) is an unassembled component view, and B) is an assembled view.
Figure 3B:
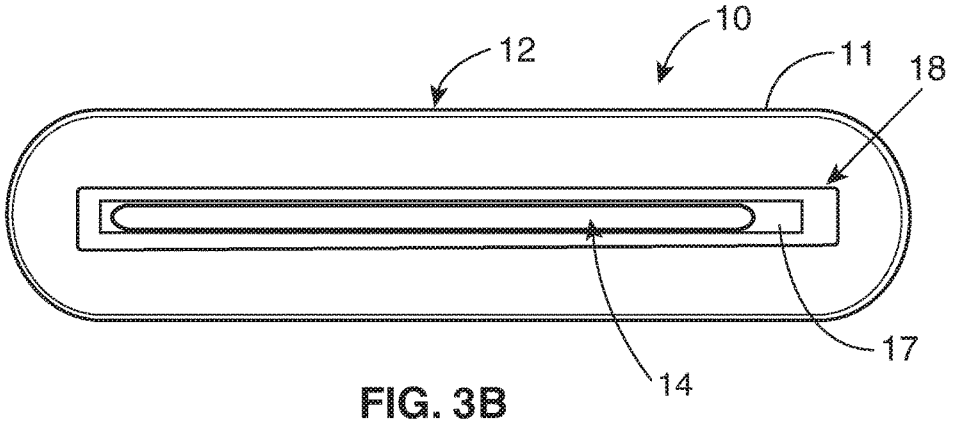
Figure 4A:
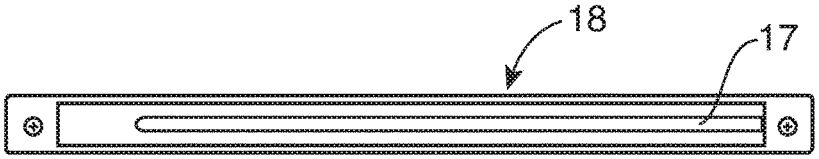
FIGS. 4A-4D show an example housing insert for the retractable fin and fin box, wherein A) is a top view, B) is a bottom view, C) is a side view, and D) is a close up side view.
Figure 4B:
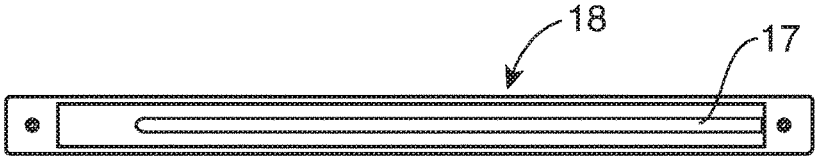
Figure 4C:
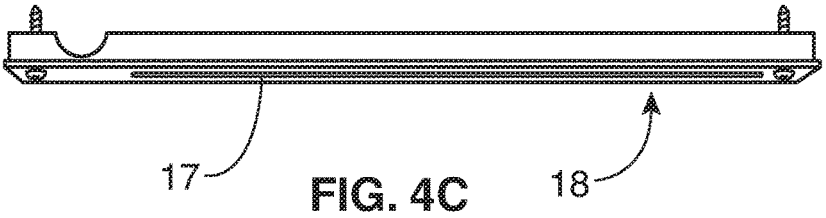
Figure 4D:
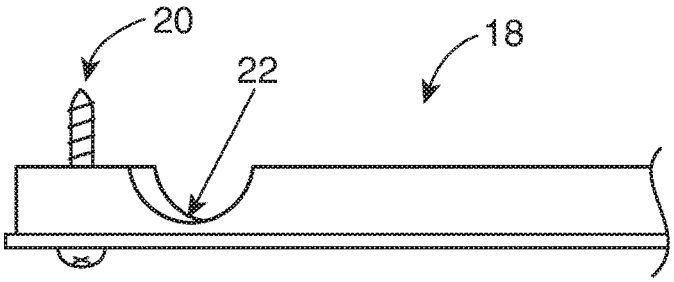

FIGS. 2A-2C show an example retractable fin and fin box, wherein A) is a side view, B) is a bottom view, and C) is a top view. FIGS. 3A-3B show an example retractable fin and fin box, wherein A) is an unassembled component view, and B) is an assembled view. In an example, the retractable fin and fin box 10 has as few moving pieces as possible. FIGS. 4A-4D show an example insert platform or housing insert 18 for the retractable fin and fin box, wherein A) is a top view, B) is a bottom view, C) is a side view, and D) is a close up side view. In an example, the insert 18 is molded to fit the top of the fin 14.

The retractable fin system includes a bias-mounted retractable fin 14 and a fin box assembly 12 with an interior chamber to retain the retractable fin 14. The interior chamber of the fin box 12 may be configured to fully retain the retractable fin 14. A channel in the fin box assembly 12 enables the retractable fin 14 to travel into and out of the fin box assembly 12.

The fin has a cylinder molded as part of the uppermost structure. This cylinder rests in a housing in the receiver box, and the housing is locked in place and attached using screws. In an example, the bottom of the fin box accepts an insert 18 that screws into place and completes the assembly, holding the fin and spring in place. This insert also prevents the fin from over-extending past its resting point.

In an example, the retractable fin 14 may be rotationally mounted in the fin box 12. In an example, the retractable fin 14 includes a rotational cylinder 21 which fits within a cylindrical opening formed by a notch 22 in the insert 18 (see FIG. 4C) and a corresponding notch 23 in the fin box 12. The first notch 22 and the second notch 23 together form the cylindrical opening which receives the rotational cylinder 21 on the fin to provide a rotational axis for pivoting the retractable fin 14 in and out of the fin box 12.

The retractable fin 14 may be maintained in an extended position by a bias 16 (e.g., a spring or other resilient member). In an example, the bias 16 is connected on one end to a mount 19 (e.g., a post) on the fin box 12. The bias 16 may also be mounted to the retractable fin 14. In another example, however, the bias 16 is not mounted to the fin and instead maintains a pressure contact with the retractable fin 14. This configuration provides a folding motion of the bias 16, enabling the retractable fin 14 to move freely and reduce friction and restriction of the bias 16. For example, the bias 16 may contact a notch 21 formed in the retractable fin 14. The bias 16 is configured to control the motion of the fin. For example, the bias 16 pushes the fin out of the fin box 12 by default, but is resilient to enable the retractable fin 14 to retract fully or partially within the fin box 12.

In an example, the top of the fin 14 is shaped in a way that prevents the fin 14 from being able to fully exit the fin box 12. For example, the fin 14 may include a ledge or stopper portion 15 that is substantially perpendicular to the blade of the fin 14, which does not pass through the channel 17 formed in the insert 18. As such, the retractable fin and the fin box are co-configured (e.g., by the stopper portion 15 and the channel 17) to fully receive the retractable fin within the interior chamber of the fin box assembly so that the retractable fin does not extend beyond a lower surface of a board the fin box assembly is mounted in when the retractable fin is in a fully retracted position.

The channel 17 of the insert 18 may also restrict lateral motion of the fin 14 when the fin 14 is in the downward position. In an example, when in a downward (fully extended) position, the fin 14 rests in the channel 17 formed in the insert 18 to restrict the fin's ability to move laterally.

In addition, the bias 16 remains in a slightly curved position, holding the fin 14 in the downward position. In this downward position, the fin 14 has the same performance as a typical fin.

The structure of the fin box 12 as described above maintains the fin 14 in a tight and precise position. Accordingly, the fin 14 does not feel loose to the rider when in use.

Figure 5A:
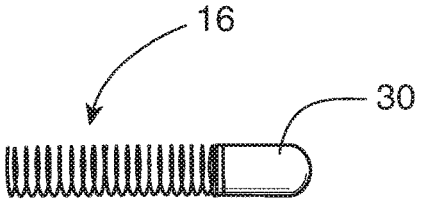
FIGS. 5A-5B show an example spring for a retractable fin and fin box, wherein A) shows the spring component, and B) shows the spring installed in a fin box.
Figure 5B:
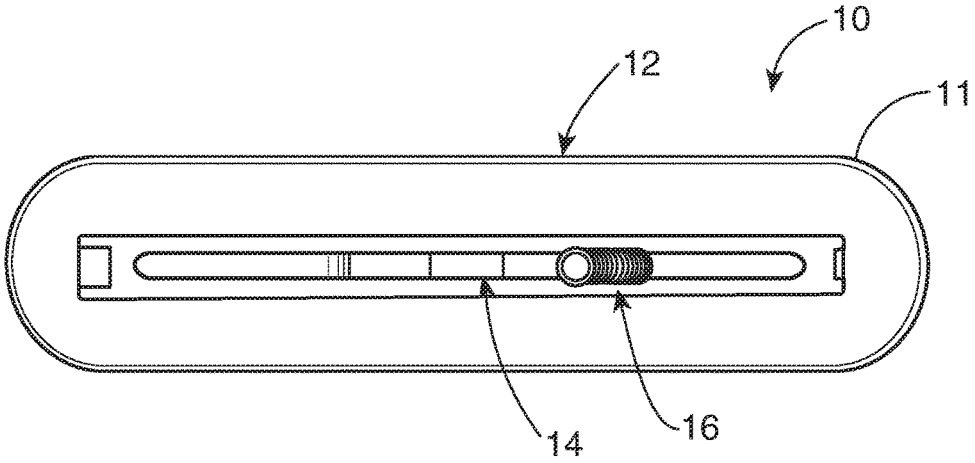
Figure 6A:
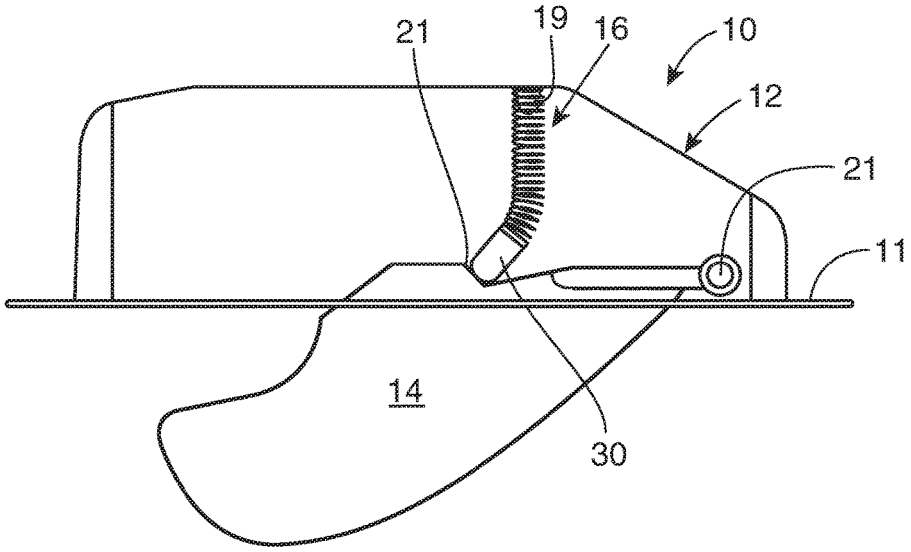
FIGS. 6A-6D illustrate example operation of a retractable fin and fin box.
Figure 6B:
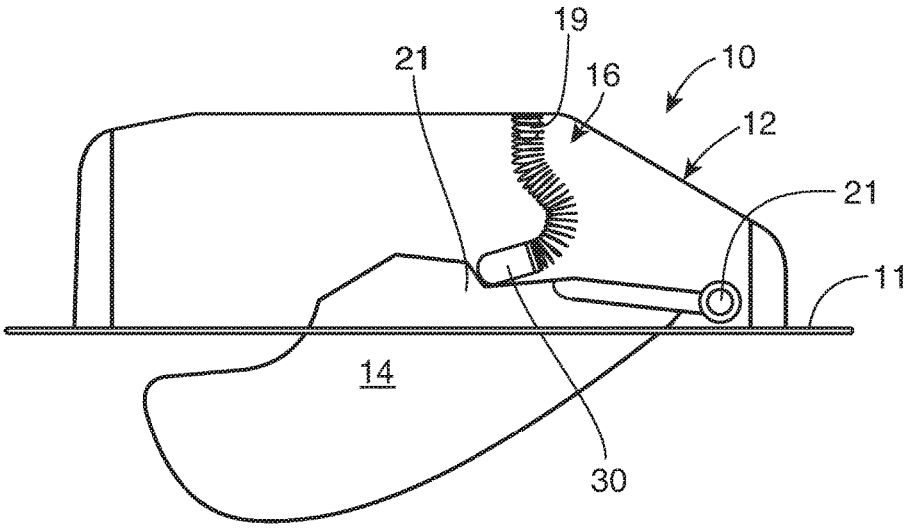
Figure 6C:
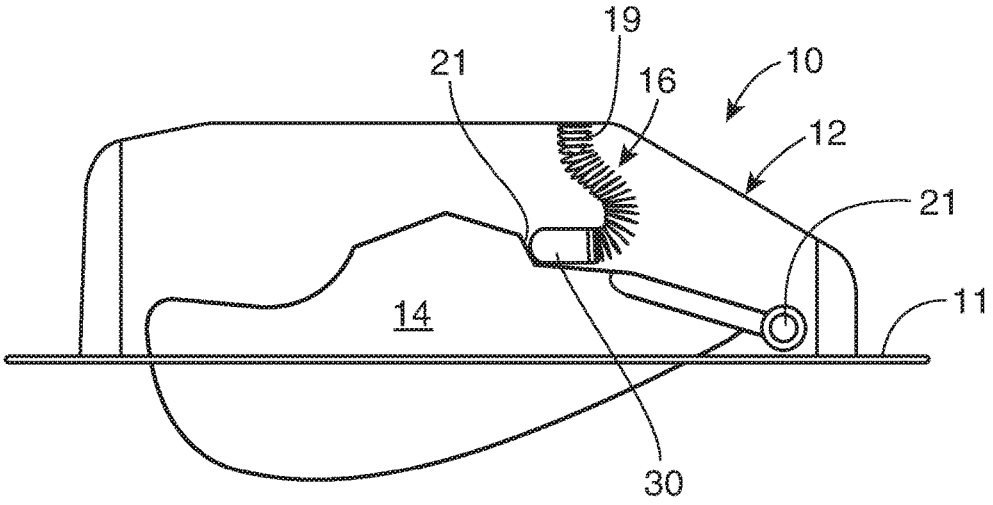
Figure 6D:
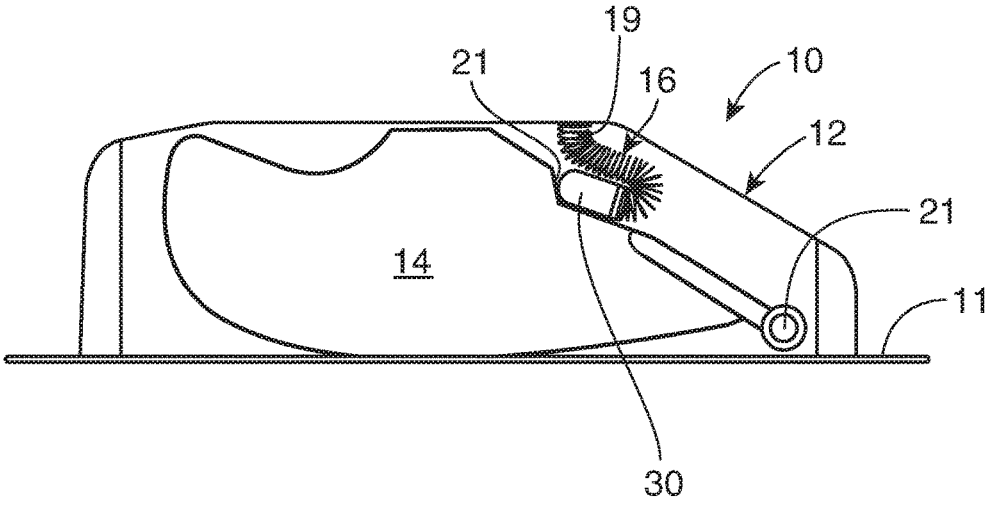

FIGS. 5A-5B show an example spring for a retractable fin and fin box, wherein A) shows the bias 16 component, and B) shows the bias 16 as it may be installed in a fin box 12. In an example, the bias 16 is a traditional coil compression spring. The bias 16 has a rubber end for frictional engagement with the notch 21 (see, e.g., FIG. 2A) formed in the retractable fin 14.

Other bias mechanisms may be implemented. Other bias mechanisms may include, but are no limited to, leaf spring, clock spring, or torsion spring. Still other mechanisms for providing a bias on the retractable fin will be understood by those having ordinary skill in the art after becoming familiar with the teachings herein.

Before continuing, it should be noted that the examples described above are provided for purposes of illustration, and are not intended to be limiting. Other devices and/or device configurations may be utilized to carry out the operations described herein.

FIGS. 6A-6D illustrate example operation of a retractable fin and fin box. In an example, the retractable fin and fin box 10 includes a housing 12, fin 14, and bias 16 (e.g., a spring or other resilient member). In an example, the fin 14 can retract inside of the housing 12, which may be in turn mounted to a board (e.g., a chamber of an inflatable board).

The spring action and motion are atypical to the motion of a typical coil spring. In an example, the spring 16 does not move in a linear fashion. Rather, the spring 16 bends and then pushes back into action.

When the fin 14 has force or pressure applied the fin 14 retracts or "disappears" into the housing 12 above the fin 14, leaving nothing on the bottom of the board that can hit or collide with things under the surface of the water. After the pressure causing the fin 14 to retract is removed, the fin moves or "springs" back in to action at full functionality.

When there is a force impacting the fin, the fin retracts or "disappears" inside the fin receiver assembly 12. This both reduces or altogether prevents damage to the fin 14 and/or aids in the user staying on the board. When there is no more pressure on the fin 14, the fin 14 returns to its original or default (e.g., extended) position under bias of the spring 16 that pushes down onto the top of the fin 14.

In an example, the fin 14 is also unique in that it is shaped to retract up into the fin box 12 at more angles than a typical fin could retract. That is, even when the board is travelling backwards (e.g., opposite of a forward direction), the fin has a ramp angle designed to take a hit and retract in to the box.

After the fin 14 moves away from the downward position, the fin receiver assembly 12 controls the fin only by the rotational cylinder 21 in notch 22 (see FIG. 4D) that is connected directly to the fin 14 held in place by the circular guide shape formed by combination of the fin box 12 and insert 18. When retracting, the fin 14 has ample room to move, and has little if any friction when retracting. This means that any water or debris that might flow in to the box chamber easily rinses itself out of the box cavity.

It is noted that the examples shown and described are provided for purposes of illustration and are not intended to be limiting. Still other examples are also contemplated.

The invention claimed is:

1. A retractable fin system, comprising:
a housing insertable into an opening in a watercraft board;
a retractable fin;
a spring to maintain the retractable fin in a default outward position from the housing, the retractable fin retracting against the spring at least partly into the housing on contact with an outside force; and
an insert platform connected to the housing;
a first notch in the insert platform to receive a rotational cylinder on the retractable fin; and
a second notch in the housing to receive the rotational cylinder on the retractable fin, the first and second notch together with the rotational cylinder forming a rotational axis for pivoting the rotational cylinder.

2. The retractable fin system of claim 1, further comprising a rim of the housing, the rim configured to be in substantially a same plane as a bottom surface of the watercraft board when the housing is fully inserted into the opening in the watercraft board.

3. The retractable fin system of claim 1, further comprising a rotational cylinder on the retractable fin.

4. The retractable fin system of claim 1, further comprising a mount for the spring in the housing.

5. The retractable fin system of claim 1, wherein the spring contacts a notch formed in the retractable fin.

6. The retractable fin system of claim 5, wherein the spring has a rubber end for frictional engagement with the notch formed in the retractable fin.

7. The retractable fin system of claim 1, wherein the spring is a coil spring to control the motion of the fin.

8. The retractable fin system of claim 7, wherein the coil spring provides a folding motion to move freely and reduce friction and resulting restricting of the coil spring.

9. The retractable fin system of claim 1, wherein the spring is selected from the group comprising: a leaf spring, a clock spring, and a torsion spring.

10. The retractable fin system of claim 1, further comprising an interior chamber of the housing, the interior chamber configured to fully retain the retractable fin.

11. A retractable fin system, comprising:
a housing insertable into an opening in a watercraft board;
a retractable fin;
a spring to maintain the retractable fin in a default outward position from the housing, the retractable fin retracting against the spring at least partly into the housing on contact with an outside force; and
a first notch in an insert platform to receive a rotational cylinder on the retractable fin.

12. The retractable fin system of claim 11, further comprising a second notch in the housing to receive the rotational cylinder on the retractable fin, the first and second notch together with the rotational cylinder forming a rotational axis for pivoting the rotational cylinder.

13. A retractable fin system, comprising:
a housing insertable into an opening in a watercraft board;
a retractable fin;
a spring to maintain the retractable fin in a default outward position from the housing, the retractable fin retracting against the spring at least partly into the housing on contact with an outside force; and
wherein the spring contacts a notch formed in the retractable fin, and
wherein the spring has a rubber end for frictional engagement with the notch formed in the retractable fin.

14. A retractable fin system, comprising:
a housing insertable into an opening in a watercraft board;
a retractable fin;
a spring to maintain the retractable fin in a default outward position from the housing, the retractable fin retracting against the spring at least partly into the housing on contact with an outside force; and
wherein the spring is a coil spring to control the motion of the fin, and
wherein the coil spring provides a folding motion to move freely and reduce friction and resulting restricting of the coil spring.

15. A retractable fin system, comprising:
a housing insertable into an opening in a watercraft board;
a retractable fin;
a spring to maintain the retractable fin in a default outward position from the housing, the retractable fin retracting against the spring at least partly into the housing on contact with an outside force; and
an insert platform connected to the housing;
wherein the spring contacts a notch formed in the retractable fin;
wherein the spring has a rubber end for frictional engagement with the notch formed in the retractable fin.

16. A retractable fin system, comprising:
a housing insertable into an opening in a watercraft board;
a retractable fin;
a spring to maintain the retractable fin in a default outward position from the housing, the retractable fin retracting against the spring at least partly into the housing on contact with an outside force; and
an insert platform connected to the housing;
wherein the spring is a coil spring to control the motion of the fin;
wherein the coil spring provides a folding motion to move freely and reduce friction and resulting restricting of the coil spring.

* * * * *